US010934599B2

(12) United States Patent
Hesse et al.

(10) Patent No.: US 10,934,599 B2
(45) Date of Patent: Mar. 2, 2021

(54) DEVICE FOR TREATING METAL WORKPIECES WITH COOLING GAS

(71) Applicant: Ipsen, Inc., Cherry Valley, IL (US)

(72) Inventors: Torsten Hesse, Kleve (DE); Marc Warmbold, Emmerich (DE); Rolf Sarres, Oberhausen (DE); Matthias Rink, Moers (DE); Markus Reinhold, Kleve (DE)

(73) Assignee: Ipsen, Inc., Cherry Valley, IL (US)

( * ) Notice: Subject to any disclaimer, the term of this patent is extended or adjusted under 35 U.S.C. 154(b) by 325 days.

(21) Appl. No.: 15/753,643

(22) PCT Filed: Jul. 15, 2016

(86) PCT No.: PCT/DE2016/000276

§ 371 (c)(1),
(2) Date: Feb. 20, 2018

(87) PCT Pub. No.: WO2017/041774

PCT Pub. Date: Mar. 16, 2017

(65) Prior Publication Data

US 2020/0208232 A1 Jul. 2, 2020

(30) Foreign Application Priority Data

Sep. 9, 2015 (DE) ..... 10 2015 011 504.9

(51) Int. Cl.
*C21D 1/62* (2006.01)
*C21D 1/767* (2006.01)
*C21D 1/613* (2006.01)

(52) U.S. Cl.
CPC ..... *C21D 1/767* (2013.01); *C21D 1/613* (2013.01)

(58) Field of Classification Search
CPC ..... C21D 1/767; C21D 1/613; C21D 1/62
See application file for complete search history.

(56) References Cited

U.S. PATENT DOCUMENTS

2003/0175130 A1* 9/2003 Loeser ..... C21D 1/613 417/313
2007/0122761 A1* 5/2007 Katsumata ..... C21D 9/0062 432/77

(Continued)

FOREIGN PATENT DOCUMENTS

DE 4403275 A1 8/1994
EP 0754768 A1 1/1997

(Continued)

*Primary Examiner* — Scott R Kastler
(74) *Attorney, Agent, or Firm* — Dann, Dorfman, Herrell and Skillman, P.C.

(57) ABSTRACT

In order to achieve an increase in energy efficiency and a faster quenching of the workpieces, a device according to the invention is proposed for the treatment of metallic workpieces with cooling gas, comprising a horizontally arranged cylindrical housing (1) with at least one closable opening for the introduction and extraction of the workpieces to be treated, with a quenching chamber (2) located inside the housing (1) for receiving the workpieces to be treated, with two high-performance fans (5 and 6) arranged laterally and outside the quenching chamber (2) for guiding a cooling gas through the quenching chamber (2) and with two heat exchangers (11 and 12) for cooling the cooling gas, that heat exchanger (11 or 12) is respectively associated with a high-performance fan (5 or 6) and that closable guide devices (17 or 18) are arranged above and below the quenching chamber (2).

7 Claims, 3 Drawing Sheets

(56) References Cited

U.S. PATENT DOCUMENTS

Figure 1:
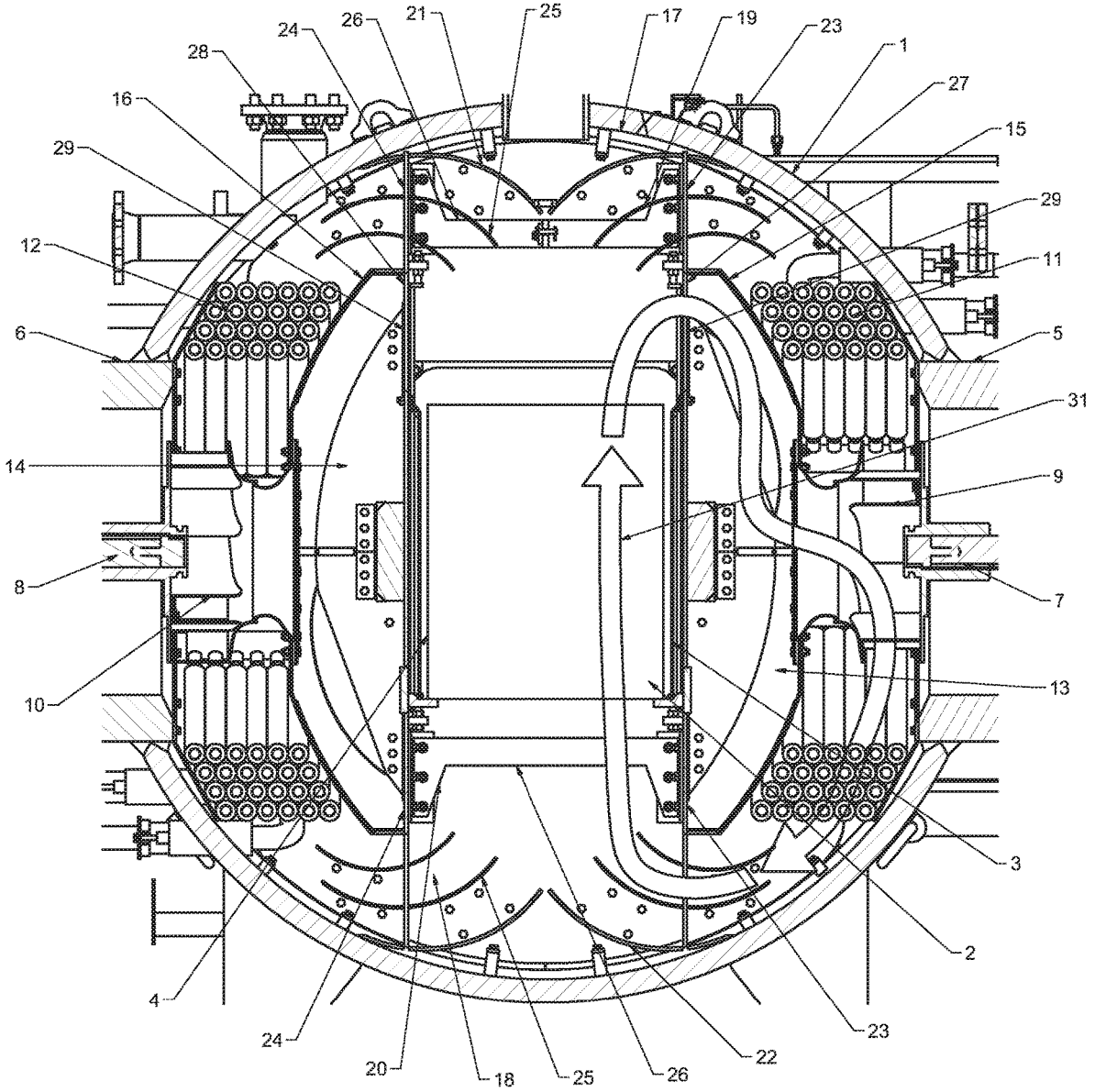

| | | | | |
|---|---|---|---|---|
| 2014/0284851 | A1* | 9/2014 | Tissot | C21D 1/767<br>266/44 |
| 2020/0208232 | A1* | 7/2020 | Hesse | C21D 1/767 |

FOREIGN PATENT DOCUMENTS

| | | | |
|---|---|---|---|
| WO | 2006042538 | A1 | 4/2006 |
| WO | 2013150488 | A1 | 10/2013 |
| WO | 2014114881 | A1 | 7/2014 |

* cited by examiner

DEVICE FOR TREATING METAL WORKPIECES WITH COOLING GAS

FIELD OF THE INVENTION

The invention relates to a device for the treatment of metallic workpieces with cooling gas, comprising a horizontally arranged cylindrical housing with at least one closable opening for the introduction and extraction of the workpieces to be treated, with a quenching chamber lying within the housing for receiving the workpieces to be treated, with two fans arranged laterally and outside the quenching chamber for guiding a cooling gas through the quenching chamber and with typically two heat exchangers for cooling the cooling gas.

STATE OF THE ART

It is well known to quench heat-treated metallic workpieces after heat treatment with a cooling gas to achieve the desired material properties. For this purpose, horizontal housings with at least one opening for feeding the hot workpieces are used in the quenching chamber arranged in the housing. The cooling gas is fed via a fan arranged in the housing and a heat exchanger in the quenching chamber and then sucked out of it by the fan. Such devices should work as energy efficiently as possible and ensure a quick and uniform cooling of the workpieces, so that the workpieces to be cooled do not warp. A too slow cooling can also lead to undesirable material properties. Thus, the cooling rate and the temperature homogeneity in the cooling gas during the quenching process are criteria that determine the quality and efficiency of the quenching process. Both can be defined essentially by the flow rate of the cooling gas, its thermophysical properties and by the achievable heat dissipation from the hot workpieces and the heat output in the heat exchangers. Thus, the location of the heat exchanger in the cooling gas circuit and its construction and the thus desired minimum pressure loss is crucial for the heat dissipation and thus the cooling rate of the workpieces and the temperature homogeneity in the cooling gas during the quenching.

A generic device for the treatment of metallic workpieces with cooling gas is known from DE 102 10 952 B4. Here, two fans are provided in a horizontal cylindrical housing right and left next to a centrally arranged quenching chamber. Furthermore, in each case a heat exchanger is arranged in the flow path of the cooling gas above and below the quenching chamber. The flow direction of the cooling gas through the quenching chamber can be reversed by four switchable reversing valves in channels for guiding the cooling gas.

This known arrangement has the disadvantage in that the two heat exchangers are arranged successively in the flow path of the cooling gas and thus significantly increase the flow resistance. Also, their size depends on the size of the quenching chamber.

DISCLOSURE OF THE INVENTION

It is an object of the present invention to design a device for the treatment of metallic workpieces with cooling gas in an energy efficient manner and to achieve a and faster cooling of the workpieces with high temperature homogeneity of the cooling gas.

This object is achieved by the features of the characterizing part of independent claim 1. Advantageous embodiments are described in the patent claims dependent on it, which taken individually or in various combinations with each other can represent an aspect of the invention.

The invention is based on the recognition that in each case one fan is associated with a heat exchanger and that closable guide devices are arranged above and below the quenching chamber. Based on this arrangement, the flow resistance for the cooling gas is reduced considerably, since only each half of the cooling gas has to flow through a heat exchanger. Since the heat exchangers no longer lie directly above and below the quenching chamber, they can have a significantly increased surface area with a larger voids fraction, which once more contributes to the reduction of the flow resistance. Large-volume flow channels in the housing can also be realized by this arrangement. A reduction of the flow resistance is thus once again achieved. These measures also lead to an increase in the achievable heat transfer coefficient and thus to a significantly higher transferable heat flow. This results in a shortening of the quenching time. Thereto the provision of a closable guide device for the cooling gas, with which a targeted homogenization of the cooling gas flow is achieved before entering into the quenching chamber, has a not insignificant influence, since it also further reduces pressure losses and thus the flow rate of the cooling gas remains higher than in the prior art.

Due to these measures, the helium commonly used as a cooling gas can be replaced by the much less expensive nitrogen. For the operator of the device according to the invention, this means a considerable reduction of the investment costs. It also achieves an improvement in quench uniformity compared to the use of helium or oil as a coolant. In comparison with helium, nitrogen possesses more turbulent flow properties, so that there is an improved mixing of the cooling gas in the flow around the workpieces to be quenched, and thus a faster heat exchange of different cooling gas regions. This improves the heat transfer and the local homogeneity of the discharged heat flows. Significantly reduced operating costs are also achieved by the use of nitrogen as the cooling gas. This also eliminates the usual helium recovery process.

It is particularly advantageous to configure the heat exchangers as ring heat exchangers. Large cooling surfaces can thus be realized with relatively low flow resistance at the same time.

It is space-saving when each ring heat exchanger encloses the impeller of its respective fan.

A simply constructed and robust guide device comprises a guide box and a guide element associated therewith. In this case, it is easily possible to install corresponding guide plates for the cooling gas in the guide boxes, so that a targeted and uniform flow is achieved when entering the quenching chamber. In this case, each guide element serves on the one hand to deflect the partial cooling gas flow to the quenching chamber and on the other hand to alternately close the associated guide box.

In order to achieve a structurally simple adjustment of the guide boxes, the two guide boxes are connected to one another via connecting elements. Then a single traversing unit is sufficient to move the two guide boxes from one position to the other position.

The control effort for the traversing unit is also simplified by this arrangement. An electric motor with adjusting device or a pneumatic or hydraulic cylinder can be used as a traversing unit. This traversing unit is preferably arranged outside the housing.

A structurally simple arrangement of the suction opening for each fan is then achieved when it is arranged above and below and laterally next to the quenching chamber. Short flow paths are achieved here. Large-volume flow channels can be also realized through this. As a result, the hot cooling gas leaving the quenching chamber can flow directly into the two fans without large flow losses and from there to the ring heat exchangers in order to be recooled again.

At the same time, it is useful to measure the traversing path of the guide boxes so that one of the two suction openings of the two fans is always closed when the cooling gas flows through the guide box adjacent to the closed suction opening. As a result, a control of the suction openings is achieved at the same time by the movement of the guide boxes, without several flaps provided with drive devices having to be synchronously adjusted. Thus, a direction reversal of the cooling gas flow can be achieved in a simple manner.

A simple attachment of the guide elements is achieved when they are fastened to the housing.

A structurally simple embodiment of the guide elements provides that they form a v-shape in cross-section and that the associated guide box has a congruent cross-sectional shape on the side facing the guide element. Then, the guide element can be used without further structural design for closing the guide box and thus to prevent the flow of the quenching chamber from this side. As a result, in turn, the flow resistance in the cooling gas circuit is further reduced and thus the homogeneity of the cooling temperature and the cooling rate of the workpieces is increased.

Heat exchangers in the sense of the present invention are understood to mean not only individual heat exchangers, but also heat exchanger packages, as are also customary in such devices.

The term "fan" is also understood to mean fans in the power range of 1 KW up to 1 MW, including high-performance fans.

SHORT DESCRIPTION OF THE DRAWING

Figure 2:
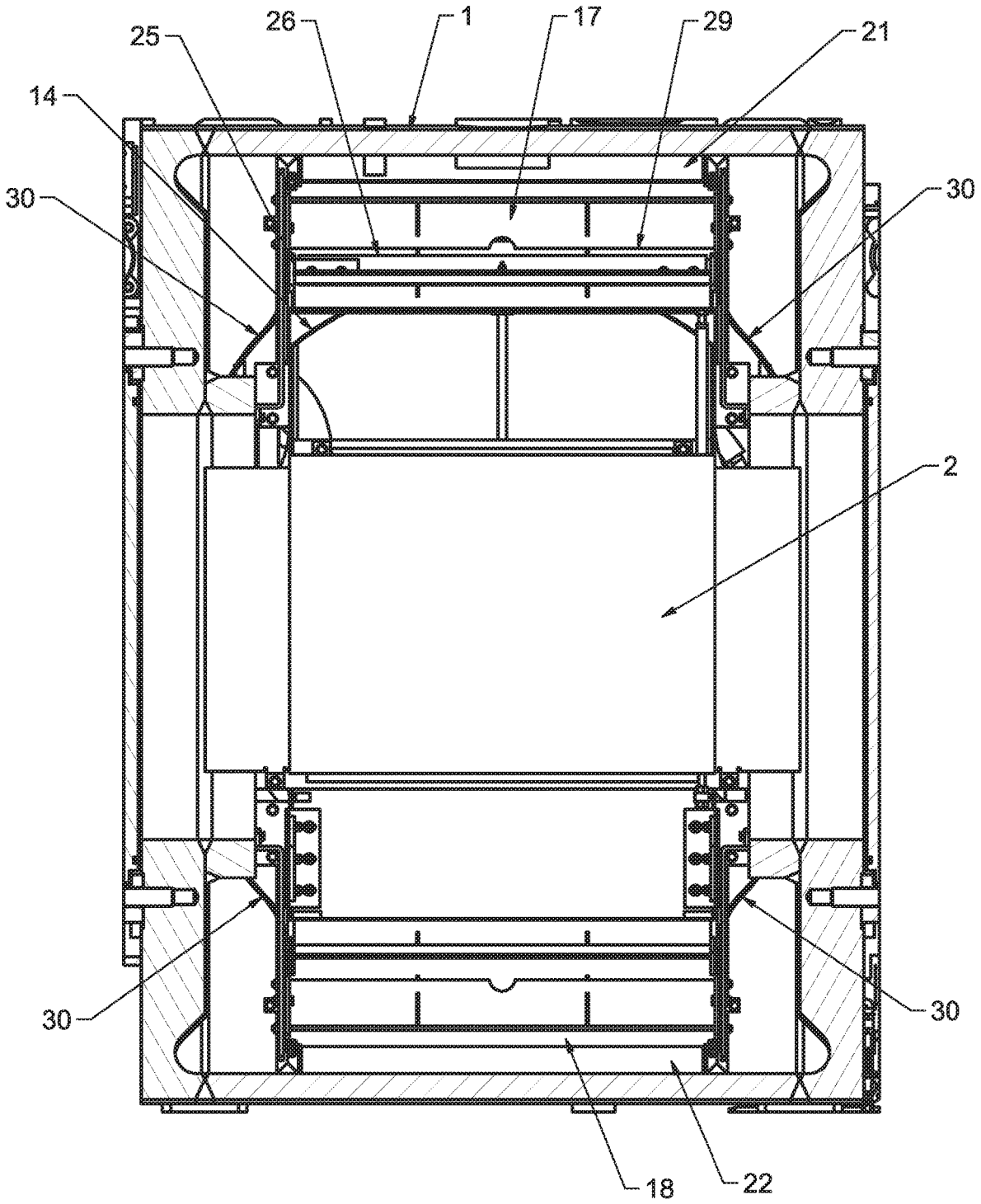

For further explanation of the invention, reference is made to the drawing, in which several different embodiments are shown in simplified form. It shows:

FIG. 1 shows a cross-section through a device constructed according to the invention for treating metallic workpieces, FIG. 2 shows a longitudinal section in a perspective view of the device according to FIG. 1, FIGS. 3*a* to *c* show individual positions of the guide boxes to achieve a flow reversal of the cooling gas.

DETAILED DESCRIPTION OF THE DRAWING

The device according to the invention comprises a cylindrical, single-walled, horizontal housing 1, on the at least one of the end face of which, not shown here, a door or a slider is provided for closing.

The quenching chamber 2 is centrally located within the housing 1, the quenching chamber being bounded at its two longitudinal sides by baffles 3 and 4. In the quenching chamber 2, two laterally arranged backing strips are provided, on which the workpieces to be quenched are deposited. These backing strips leave open a maximum flow cross-section to the workpieces. The quenching chamber itself is in this case dimensioned such that it encloses the workpieces to be quenched as closely as possible.

Laterally next to the quenching chamber 2, two horizontally arranged fans 5 and 6 are provided, the drive motors 7 and 8 of which (only partially visible) are connected via gas-tight flange connections directly to the housing 1. The drive shafts of the two fans are arranged in alignment with each other. The impellers of the high-power fans 5 and 6 are designated 9 and 10. The fans 5 and 6 are configured as high-performance fans.

A ring heat exchanger 11 and 12 is attached in each case to the impellers 9 and 10. These ring heat exchangers can be constructed in one or more parts, round or crescent-shaped. The ring heat exchangers are constructed in four parts in the illustrated embodiment. A baffle housing, not shown here, for the low pressure loss guidance of the cooling gas is arranged around the heat exchangers.

In each case, an intake tract 13 and 14 is located between the two baffles 3 and 4 and the suction region of the fans 5 and 6, which intake tract is limited on the side of the fan 5 and 6 by an inner partition plate 15 and 16.

Above and below the quenching chamber 2, a guide device 17 and 18 is provided on the entire width and length of the quenching chamber. Each guide device 17 and 18 comprises a guide box 19 and 20 and an associated guide element 21 and 22. The guide elements 21 and 22 are formed v-shaped in cross-section and rigidly fastened to the inside of the housing 1.

Each guide box 19 and 20 has closed side walls 23 and 24. Guide plates 25 are arranged in each guide box 19 and 20 parallel and perpendicular to the side walls 23 and 24 so that honeycomb rectangular guide channels 26 (FIG. 2) are formed for the cooling gas. The guide plates 25 are designed such that they correspond in cross-section (FIG. 1) to the shape of the guide elements 21 and 22.

Both guide boxes 19 and 20 are connected to each other by lateral connecting struts 27 and 28. These connecting struts are arranged so as to allow a nearly lossless flow connection from the quenching chamber to the intake tracts 13 and 14. A traversing unit, not shown, makes it possible to move the two guide boxes, as will be further explained below.

FIG. 2 shows a perspective longitudinal section through the device according to the invention. Here, on the one hand, the construction and the arrangement of the guide channels 26 can be seen very clearly and, on the other hand, one of the four suction openings 29 of the intake tract 14. It is located above the quenching chamber 2. A further suction opening, not shown, is located below the quenching chamber. The intake tract 13 has corresponding suction openings.

Furthermore, FIG. 2 shows the arrangement of shielding plates 30, which are arranged above and below, on the front side and the rear side of the quenching chamber 2 and extend from these to the inside of the housing 1. This prevents cooling gas from flowing in this by bypassing the cooling channels 26 of the front side and back side of the quenching chamber. This ensures that the quenching chamber 2 is always only flowed through vertically.

The quenching chamber 2 is loaded through the front opening by means of an external device with a batch of workpieces that has been previously heated in a separate device and optionally carbonized. The quenching chamber 2 is unloaded either through the front opening or through a rear opening, if it is a continuous quenching chamber.

Figures 3A, 3B, 3C:
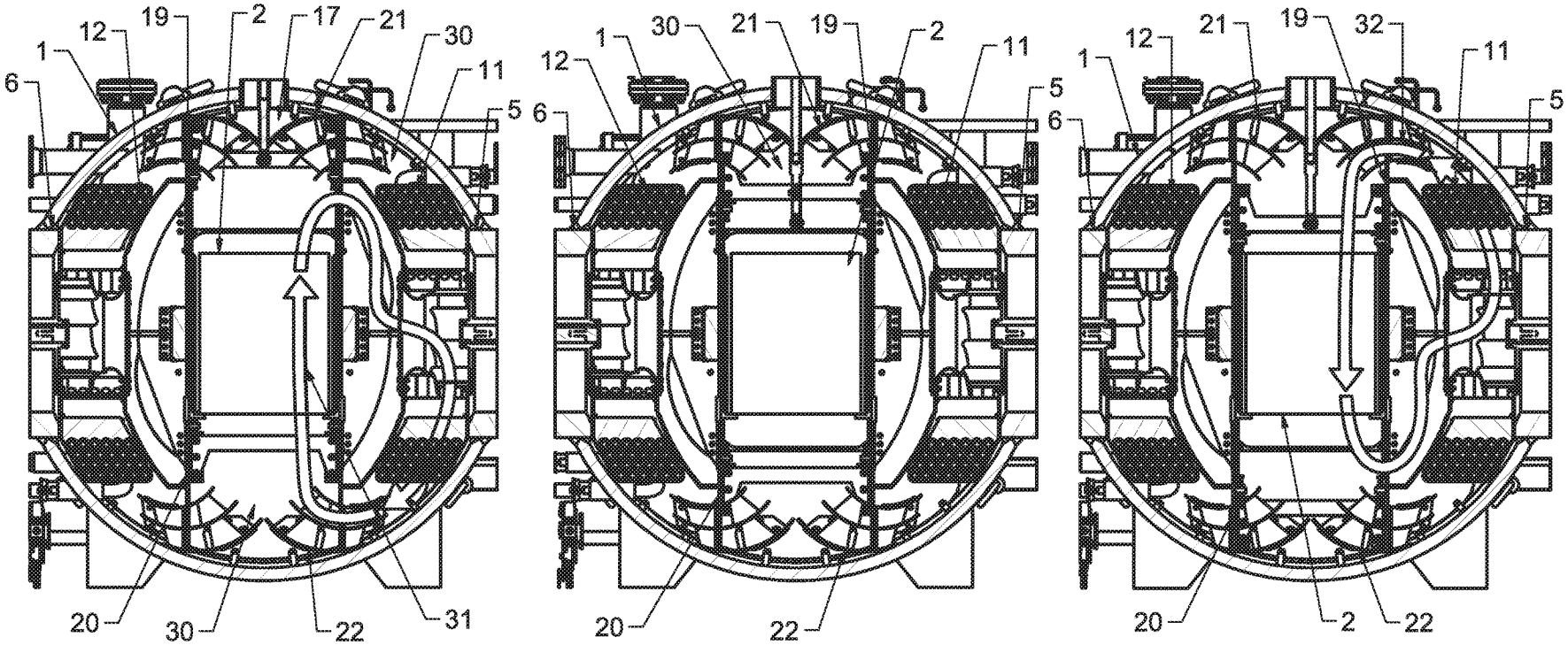

In FIGS. 1 and 2 and 3*a*, the cooling gas flows through the quenching chamber from bottom to top. This is indicated by a flow arrow 31. For this purpose, the guide device 17 is located in its upper end position, i.e., the upper guide box 19 abuts its guide element 21. As a result, its guide channels 26 are closed and therefore can not be flowed through. At the same time, the lower guide box 20 is spaced from its guide element 22, such that its guide channels 26 can be flowed through freely. The two upper suction openings 29 are released to the two intake tracts 13 and 14 by this position of the two guide elements 17 and 18, while the side walls 23 and 24 of the lower guide box 20 close the lower two suction openings 29.

The cooling gas heated by the hot workpieces in the quenching chamber is therefore divided and suctioned by the two upper suction openings 29 into two partial flows, led to the two high-performance fans 5 and 6 and pushed by them radially through the ring heat exchangers 11 and 12, wherein it is cooled. It then flows through the spiral guide housing running around the ring heat exchangers 11 and 12 and, via the guide element 22, deflected by the lower guide box 20 from below into the quenching chamber 2. The two partial flows of the cooling gas are brought together again before and in the guide box 20. The guide channels 26 align the flow of the cooling gas vertically again.

If the flow direction of the cooling gas is now to be reversed (contrary to the flow direction in FIGS. 1, 2 and 3*a*), the traversing device for the two guide boxes 19 and 20 is activated. This shifts the guide boxes from their upper position (FIG. 1, 2, 3*a*) via a central position (FIG. 3*b*), in which both guide boxes are removed from their guide elements, to the lower position (FIG. 3*c*). In this position, the guide channels 26 are closed in the lower guide box 20 by the guide element 22. At the same time, the upper suction openings 29 are closed by the side walls 23 and 24 of the upper guide box 19, while the lower suction openings 29 are released to the intake tracts 13 and 14. Since the upper guide box 19 is now positioned away from its guide element 21, the guide channels 26 are opened in this guide box 19.

The cooling gas thus now flows via the two lower suction openings 29 into the intake tracts 13 and 14. From there it flows on via the impellers 9 and 10 of the high-performance fan 5 and 6 radially through the ring heat exchangers 11 and 12. Via the spiral guide housing, now recooled cooling gas now flows vertically down through the quenching chamber 2, after which the two partial flows had been previously deflected by the guide element 21 and had been guided and directed together by the guide channels 26 in the guide box 19. This is illustrated in FIG. 3*c* by the flow arrow 32.

As a result of this simple adjustment of the guide devices 17 and 18, a flow reversal of the cooling gas is rapidly achieved if it requires the contour of the workpieces to be quenched.

LIST OF REFERENCE NUMBERS

1 housing
2 quenching chamber
3 side wall of 2
4 side wall of 2
5 fan
6 fan
7 drive motor of 5
8 drive motor of 6
9 impeller of 5
10 impeller of 6
11 ring heat exchanger
12 ring heat exchanger
13 intake tract of 5
14 intake tract of 6
15 inner partition plate of 13
16 inner partition plate of 14
17 upper guide device
18 lower guide device
19 guide box of 17
20 guide box of 18
21 upper guide element
22 lower guide element
23 side walls of 18, 19
24 side walls of 18, 19
25 guide plates in 18, 19
26 guide channels
27 connecting struts
28 connecting struts
29 suction openings
30 shielding plates
31 flow arrow
32 flow arrow

The invention claimed is:

1. A device for the treatment of metallic workpieces with cooling gas, comprising a horizontally arranged cylindrical housing (1) with at least one closable opening for the insertion or extraction of the workpieces to be treated, with a quenching chamber (2) lying within the housing (1) for receiving the workpieces to be treated, with two fans (5 and 6) arranged laterally and outside the quenching chamber (2) for guiding a cooling gas through the quenching chamber (2) and with two heat exchangers (11 and 12) for cooling the cooling gas, characterized in that a respective heat exchanger (11 or 12) is positioned to receive the cooling gas from one of the fans (5 or 6) and that movable gas flow guide devices (17 and 18) are arranged above and below the quenching chamber (2), wherein the movable gas flow guide devices each comprise a guide box (19, 20) and a guide element (21, 22), said guide boxes being connected to each other by connecting struts (27, 28), said guide boxes being movable by a traversing unit for opening or closing suction openings (29) for each fan (5, 6), one of said suction openings being positioned above and laterally next to the quenching chamber (2) and another of said suction openings being positioned below and laterally next to the quenching chamber, whereby the gas flow guide elements (21, 22) are operable to.

2. The device according to claim 1, characterized in that the heat exchangers (11 and 12) are ring-shaped.

3. The device according to claim 2, characterized in that each ring heat exchanger (11 or 12) surrounds an impeller (9 or 10) of the associated fan (5 or 6).

4. The device according to claim 1 characterized in that each guide box (19 or 20) has two side walls (23 and 24), between which guide plates (25) are arranged, which form guide channels (26) for guiding the cooling gas.

5. The device according to claim 4 characterized in that a traversing path of the guide boxes (19 and 20) is dimensioned such that the suction openings (29) are closed by the side walls (23 and 24) of one of the guide boxes (19, 20) when the guide channels (26) are opened by the other guide box (20, 19).

6. The device according to claim 1 characterized in that the guide elements (21 and 22) are fastened on the inside of the housing (1).

7. The device according to claim 6 characterized in that each guide element (21 or 22) is configured v-shaped in cross-section, that the surface of the guide box (19 or 20) facing the guide element (21 or 22) is designed such that guide boxes (19 or 20) whose guide channels (26) are closed abut the guide element (21 or 22).

* * * * *